United States Patent [19]

Botkin

[11] 4,172,539

[45] Oct. 30, 1979

[54] AERATOR NOZZLE

[75] Inventor: Lawrence A. Botkin, Omaha, Nebr.

[73] Assignee: Fruehauf Corporation, Detroit, Mich.

[21] Appl. No.: 816,851

[22] Filed: Jul. 18, 1977

[51] Int. Cl.[2] ..... B65G 3/14

[52] U.S. Cl. ..... 222/195; 366/107; 406/137

[58] Field of Search ..... 302/53, 29; 222/195; 366/107

[56] References Cited

U.S. PATENT DOCUMENTS

| | | | |
|---|---|---|---|
| 3,929,261 | 12/1975 | Solimar | 302/53 |
| 4,030,755 | 6/1977 | Heimke | 302/53 |
| 4,057,155 | 11/1977 | Deeks | 302/53 |

FOREIGN PATENT DOCUMENTS

| | | | |
|---|---|---|---|
| 1066167 | 4/1967 | United Kingdom | 222/195 |

*Primary Examiner*—John J. Love
*Assistant Examiner*—Jeffrey V. Nase
*Attorney, Agent, or Firm*—Snyder, Brown & Ramik

[57] ABSTRACT

An aerating or fluidizing device is located adjacent the gravity discharge opening of a hopper. The device is in the form of a flexible, resilient member fixed so that a marginal edge normally contacts and defines an interface with an associated surface. Air under pressure is fed to the interface in such fashion as to cause the marginal edge of the resilient member to flutter and allow the air to escape in randomly directed "puffs." The fluttering movement combined with the intermittent puffs of air causes pulverulent material to be agitated, aerated and/or fluidized as it passes to the discharge opening.

6 Claims, 16 Drawing Figures

AERATOR NOZZLE

BACKGROUND OF THE INVENTION

Contemporarily, pulverulent materials are transported in and discharged from tank vehicles, the discharging being effected through a closed system to minimize contamination of the atmosphere by dust. When discharging powdered materials such as cement, discharge is greatly facilitated if the material is aerated or fluidized before entering the piping system through which the product is pneumatically conveyed. The vehicles may be in the form of elongate, substantially horizontal tanks with one or more discharge hopper devices along their lower side to which the product may migrate by gravity to the pneumatic conveying piping system, a portion of which may be carried by the vehicle itself. The interior of the tank may be pressurized to facilitate the discharge, and as above noted, the discharge is greatly facilitated if the material is aerated or fluidized before entering the pneumatic conveying pipe system. A common means of achieving fluidization is the use of porous or similar elements through which air is introduced into the hopper of the tank whereby fluidization of the material adjacent the discharge mouth is effected thereby to assist in conveying the material to the discharge port. These porous elements or pads exhibit certain undesirable characteristics, in particular their propensity to blinding due to the fact that the air passed therethrough normally contains a certain amount of foreign material or dust which gradually fills the pores of the material (i.e., canvas). Also, these porous pads make it difficult to clean the hopper assembly.

However, without some form of aid, bulk products such as cement when discharged through the narrowed hopper outlet mouths tends to pack or bridge at these outlets and it is therefore relatively essential that some means be provided to aid in this discharge.

BRIEF SUMMARY OF THE INVENTION

Accordingly, it is of primary concern in connection with this invention to provide means for decreasing the tendency of bulk products being discharged from a hopper structure from packing or bridging at the outlet Essentially, this means incorporates a resilient, flexible member having a marginal edge portion normally sealing against the hopper interior or other surface but which is free to vibrate or flutter with respect thereto, and means for supplying air to the interface between the flexible member and the supporting surface therefor. The air so supplied is under sufficient pressure to cuase the marginal edge of the resilient member to vibrate or flutter whereby the vibration itself creates an agitating action on the bulk product in the immediate vicinity of the device and, as well, causes the air to be expelled in discrete puffs or jets thereof which are randomly directed. The jets of air which flow as a result of the fluttering movement effect a fluidizing and conveying action on the agitated bulk product.

More specifically, the resilient, flexible member takes the form of a body of rubber or like material having a central portion which serves to anchor the body and a marginal edge portion remote from the central portion and which is free to vibrate. At a region between the central and marginal portions, the pressurized air is introduced to effect the fluttering or vibrating movement of the marginal portion, thereby to create the agitating effect and the random jetting of the air.

Preferably, the resilient body is of circular plan view and the circumscribing marginal edge portion lies flatwise or in face-to-face contact with a supporting surface which may be an interior surface of the hopper structure itself or it may be part of a structure attached to or otherwise embodied in the hopper structure.

BRIEF DESCRIPTION OF THE DRAWING FIGURES

DETAILED DESCRIPTION OF THE INVENTION

Figure 1:
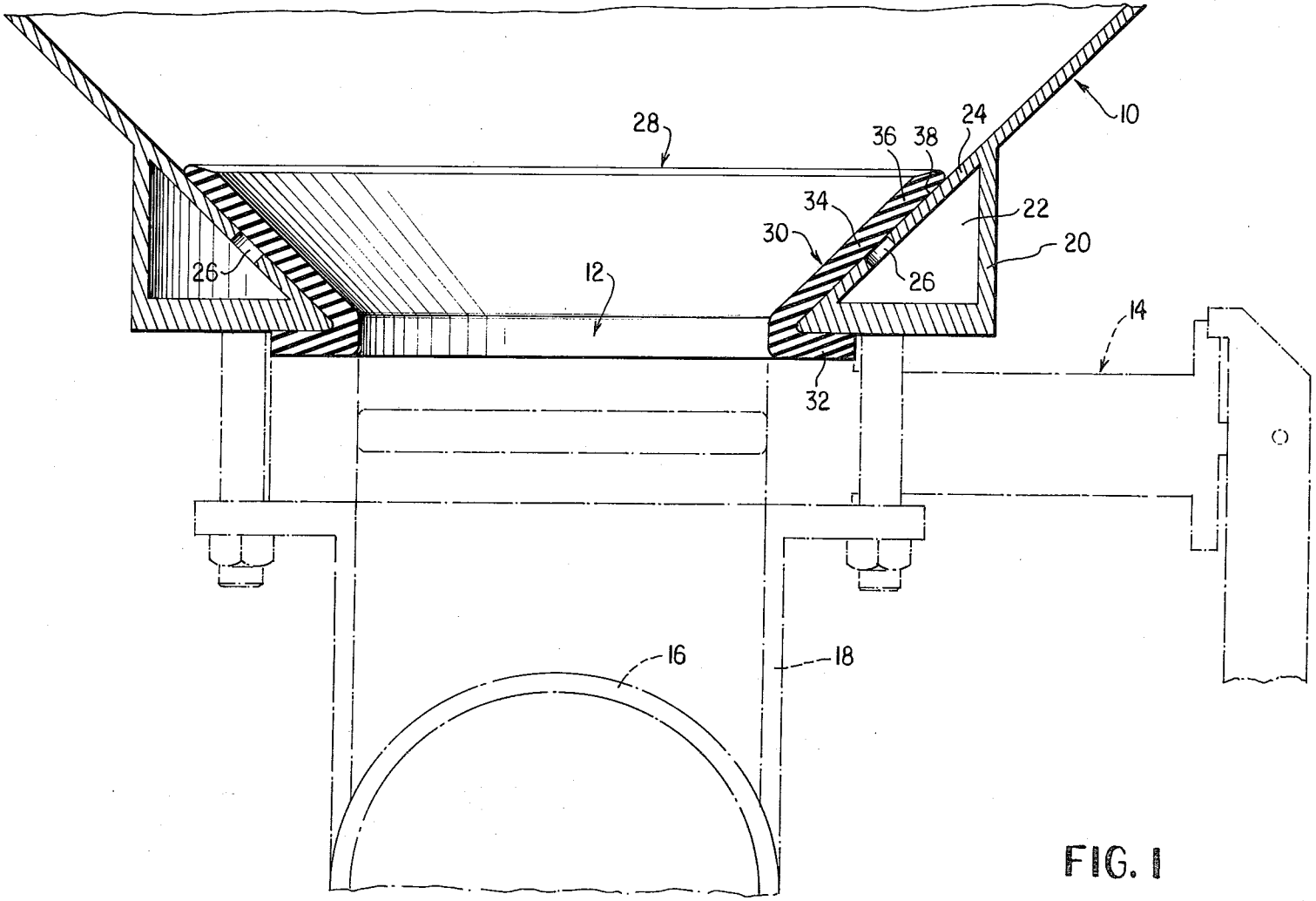
FIG. 1 is a vertical section taken through the hopper outlet of a tank vehicle and illustrating certain concepts according to the present invention.

With reference to FIG. 1, an outlet hopper indicated generally by the reference character 10 is illustrated therein which, it is to be understood, is of conventional construction in association with bulk product tank vehicles. The hopper is provided with a discharge mouth 12 and as is indicated in phantom lines in FIG. 1, associated therewith is a valve indicated generally by the reference character 14 which permits selective opening of the discharge mouth 12 to allow discharge of the bulk product contained in the tank vehicle. The hopper structure 10 ordinarily is one of several which are provided in association with and along the bottom side of the tank vehicle and the valve 14 forms an integral part of the vehicle structure as does the distribution pipe 16. The conventional structure also includes the pipe stub 18 which discharges into the main line 16, all of which is conventional in the art. It is also conventional in these tank vehicles to provide a motor driven blower which not only discharges air into the outlet line 16 to allow fluid conveying of the bulk product but which also has a connection which pressurizes the interior of the tank, thereby aiding in the expulsion of the bulk product. It will be appreciated that at one end the distribution line 16 is connected to the user's distribution system for delivering the bulk product to the desired site.

The pulverulent material contained in the tank vehicle may be a relatively fine powder such as cement and, for this reason, it may tend to pack or bridge over the discharge mouth 12, thus interrupting the efficient and steady flow of material to the discharge conveying pipe 16.

In the embodiment of the invention as is illustrated in FIG. 1, the hopper structure 10 is provided with a manifold formed by the wall means 20 and having an interior 22 which is provided with a suitable connection (not shown) with the pressurized air system to maintain air under the requisite pressure within the manifold interior 22. Around the periphery of the hopper wall 24 there are provided a series of circumferentially spaced openings 26 through which the pressurized air may escape from the manifold.

Cooperatively associated with the discharge openings 26 is the agitating and aerating means indicated generally by the reference character 28 and which, in this embodiment of the invention, takes the form of a frustoconical section of rubber or like material 30 engaging in face-to-face contact with the interior of the hopper wall 24 just adjacent to the discharge opening 12 and further including a central portion 32 which extends radially in the form of an annular flange around the discharge opening 12, as shown.

Thus, the member 30 includes an intermediate portion 34 which normally closes the manifold opening 26 and a marginal edge portion 36 lying flatwise or in face-to-face contact with the interior of the hopper wall 24 to define an interface 38. If the pressure of the air within the manifold interior 22 is maintained at a proper value, air will be supplied to the interface 38 at a pressure sufficient to cause the marginal edge 36 of the agitating and aerating means 28 to flutter or vibrate with a consequent periodic or interrupted escape of air in the form of air jets directed upwardly along the inner surface of the hopper wall 24 and at random circumferential spacings therearound. The pressure of air maintained within the interior of the manifold 22 ordinarily will be in the order of 1–10 psig if the interior of the tank vehicle is under normal atmospheric pressure. If the interior of the tank vehicle is maintained under some positive pressure in order to expedite the discharge as mentioned above, then the pressure in the manifold 22 ordinarily will range at a pressure from 1–10 psi higher than its internal pressure. In either case, the air flow rate passing the agitating and aerating means 28 will be in the order of from 10–400 standard cfm.

As described above, it will be appreciated that the agitating and aerating means 28 causes the escaping air to flow in random, interrupted fashion by the fluttering or vibrating action of the marginal edge 36 which randomly occurs around the periphery of such portion 36. As a result, not only is the pulverulent material agitated in the vicinity immediately adjacent the discharge mouth 12, but an aerating or fluidizing effect is achieved thereon, the net result being that a steady and efficient discharge flow of material is achieved.

Figures 2, 3:
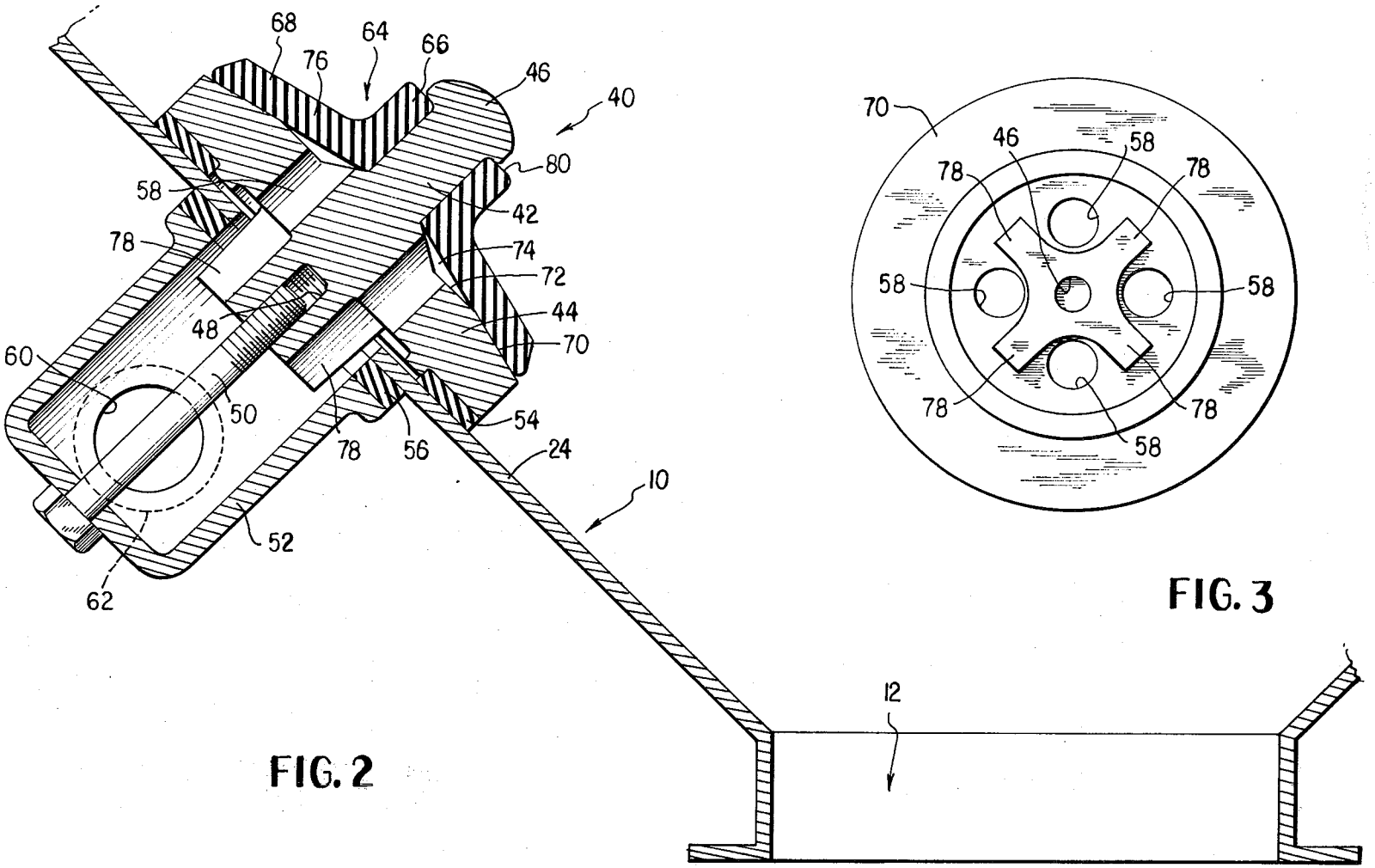
FIG. 2 is a vertical section taken through a hopper assembly showing a modified form of the invention.
FIG. 3 is a plan view of the agitating and aerating device shown in FIG. 2.

FIG. 2 illustrates a modified embodiment of the invention. Again, the hopper structure which is of conventional nature is indicated by the reference character 10 and includes the discharge opening or mouth 12 as described hereinbefore. In the modification according to FIG. 2, a plurality of agitating and aerating devices indicated generally by the reference character 40 are attached to the hopper wall 24 in circumferentially spaced relation to each other immediately above the discharge opening or mouth 12. Only one of these devices is illustrated in FIG. 2.

The device 40 comprises a metallic or otherwise rigid body member having a central stem portion 42 and a radially projecting disc portion 44. The stem 42 projects upwardly from the disc portion 42 and terminates in an enlarged retaining head 46. The underside of the stem 42 is provided with a threaded bore 48 receiving the bolt 50 by means of which the cap member 52 is secured to the body. The hopper wall 24 is provided with an opening receiving the assembly with the disc portion 44 on the inner side thereof and the cap portion 52 on the outer side as shown, there being suitable sealing gaskets 54 and 56 positioned as shown so that when the bolt 50 sandwiches the hopper wall 24 between the two members, the opening is sealed off. The body member is provided with a plurality of through bores as indicated at 58 in FIG. 3 which communicate the upper side of the disc portion 44 with the interior of the cap portion 52 and the cap portion 52 is provided with a suitable outlet opening 60 and associated nipple portion 62 for connection to a source of pressurized air. The resilient body 64 includes the generally cylindrical central portion 66 which snuggly fits the stem portion 42 immediately below the retaining head 46 and includes the skirt portion projecting radially therefrom to terminate in the outer marginal edge portion 68 which seats upon the slightly inclined frusto conical surface 70 of the body member outboard of the openings 58, substantially as is shown. The body member is bevelled slightly as is indicated by the reference character 72 in the region of the openings 58 to form a manifold space 74 immediately underlying the intermediate portion 76 of the resilient skirt.

The operation of the device shown in FIG. 2 is essentially the same as that described in conjunction with FIG. 1. That is to say, pressurized air is continuously maintained in the interior of the cap 52 through the opening 60 under sufficient pressure to cause fluttering or vibration of the marginal edge portion 68 of the resilient member 64, again to provide intermittent puffs or jets of air to be expelled at random circumferentially spaced positions. One feature of the construction according to FIG. 2 is the fact that the interface 70 is downwardly inclined as illustrated to direct the puffs of air toward the inner surface of the wall 24. As shown in FIG. 3 it will be appreciated that the underside of the disc 44 is provided with a series of fingers 78 which project outwardly somewhat to separate the spaces between adjacent through bores or openings 58.

Figure 4:
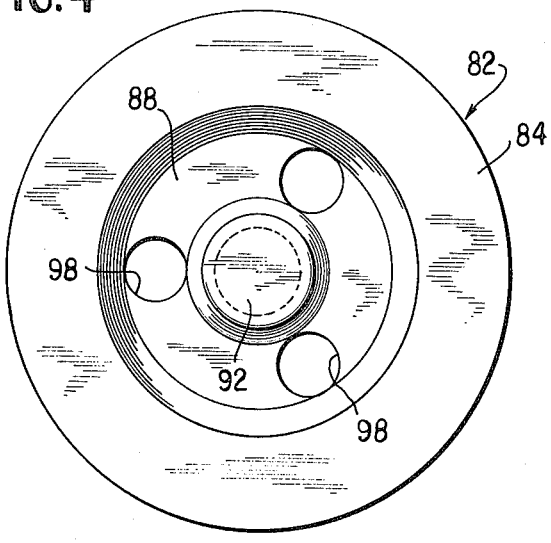
FIGS. 4, 6, 8 and 10 are plan views of several embodiments of base member according to the present invention and FIGS. 5, 7, 9 and 11 respectively are sectional views taken through the complete assemblies.

FIGS. 4–11 illustrate certain further principles according to the present invention. In FIG. 4, the support member 82 which corresponds to the member shown in FIG. 2 is provided with a flat marginal edge surface 84 on its skirt portion 86 and is provided with a central recess portion 88 surrounding the stem 90. As before, the stem 90 terminates in an enlarged head portion 92, see particularly FIG. 5 which serves to retain the central cylindrical portion 94 of the flexible member such that its skirt 96 normally is retained in face-to-face contact against the surface 84 to provide the interface thereat. In the embodiment shown, through bores 98 are provided and these lead to the recessed portion 88 to provide the manifold space 96. Thus, the pressurized air is uniformly supplied to the interface 100 circumferentially thereof whereby to allow the random vibrating and fluttering action and the concomitant intermittent and randomly directed jets of air as previously described.

Figure 6:
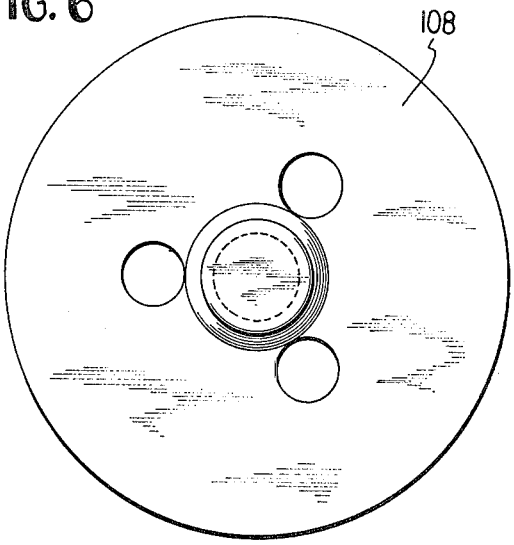
Figure 5:
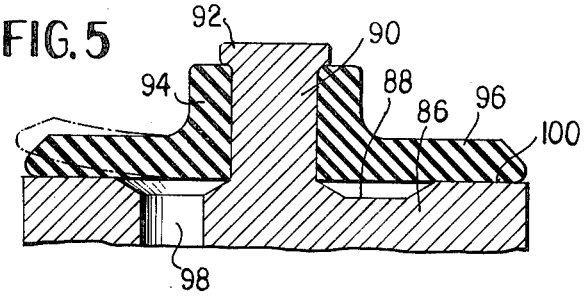
Figure 7:
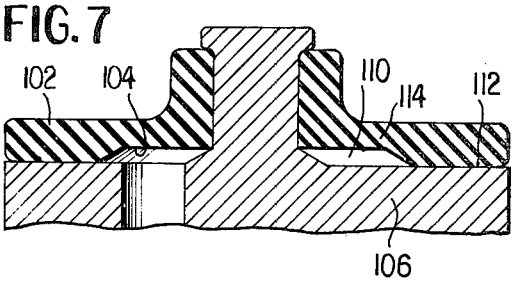

In contrast, in FIGS. 6 and 7 there is shown an arrangement wherein the flexible member 102 itself is provided with a recess 104 whereas the skirt 106 is provided with an entirely flat surface 108 whereby the recess 104 cooperates therewith to provide the manifold space 110. Again, a uniform circumferential distribution of pressurized air is applied to the interface 112. Additionally, in this embodiment, the narrowed thickness of the intermediate portion 114 allows a more lively action for the outer marginal edge portion.

Figure 8:
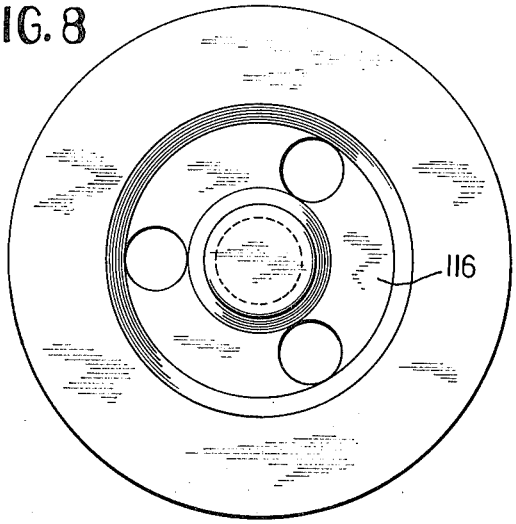
Figure 9:
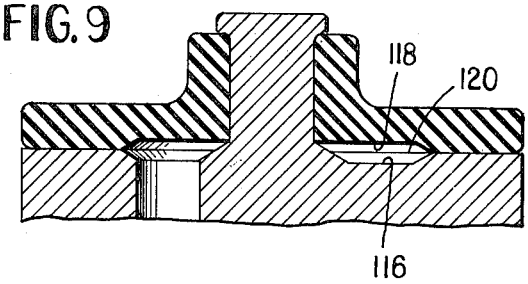

In FIGS. 8 and 9 a further embodiment is shown wherein both the skirt of the support member is recessed as shown at 116 and the intermediate portion of the resilient member is likewise recessed whereby these two recesses cooperate to present the manifold space 120.

Figure 10:
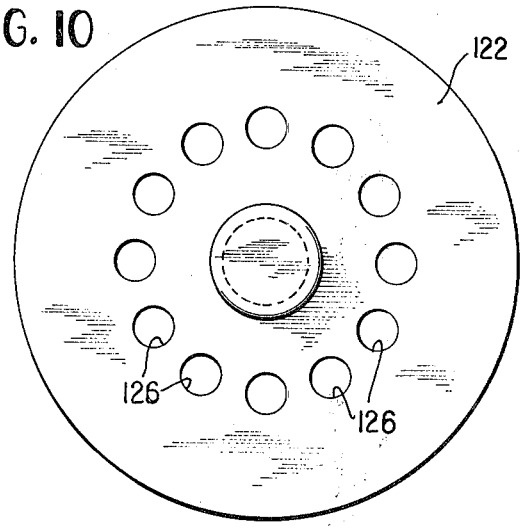
Figure 11:
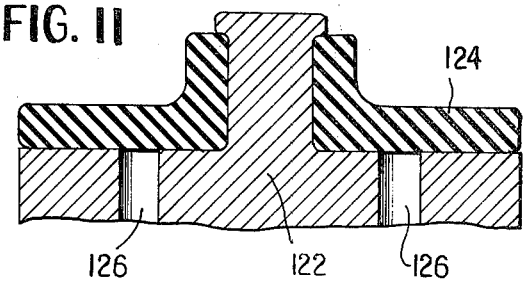

Lastly, in FIGS. 10 and 11, the support body is provided with a flat surface 122 and the underside of the flexible skirt 124 likewise is flat so that no manifold space as such is formed therebetween in the intermediate portion of the skirt. However, in this case, a plurality of closely spaced and circumferentially distributed through bores 126 achieve essentially the same effect as the manifold space previously described but, again, the cooperation is such as enhances the random jetting effect previously described.

Figure 13:
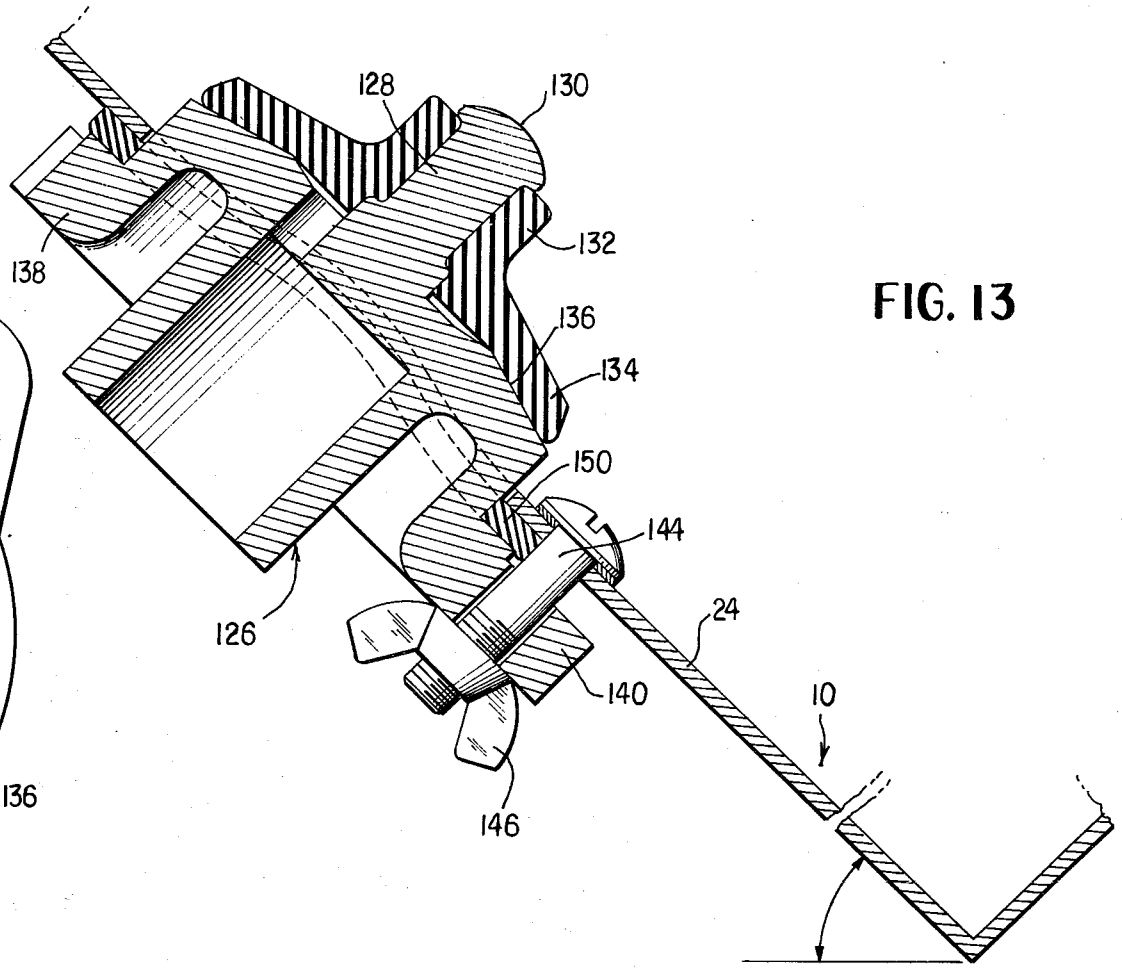
FIG. 13 is a vertical section taken substantially along the plane of section line 13—13 in FIG. 12.
Figure 12:
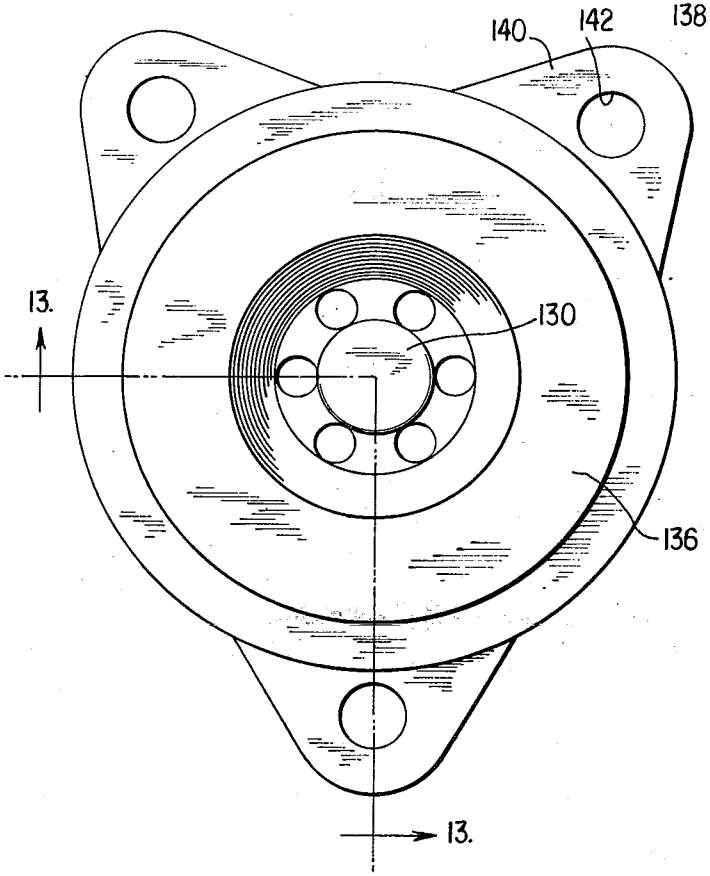
FIG. 12 is a plan view of a further modification of the invention.

A still further embodiment of the invention is illustrated in FIGS. 12 and 13. The embodiment illustrated is characterized by the fact that it is very easily dismounted from the hopper wall 10. In this form of the invention, the support body 126 as before includes the stem 128 and the surmounting enlarged head 130 to retain the cylindrical central portion 132 of the resilient member, the outer marginal edge 134 of the skirt overlying and contacting an annular surface of the body 126 to present the interface 136. The body 126 is provided with a flange 138 provided with integral ears 140 each of which is provided with a bore 142 for receiving a bolt 144 and associated wing nut 146, the body 126 being clamped sealingly against the outer surface of the wall 10 by means of the annular sealing gasket 150.

Figure 14:
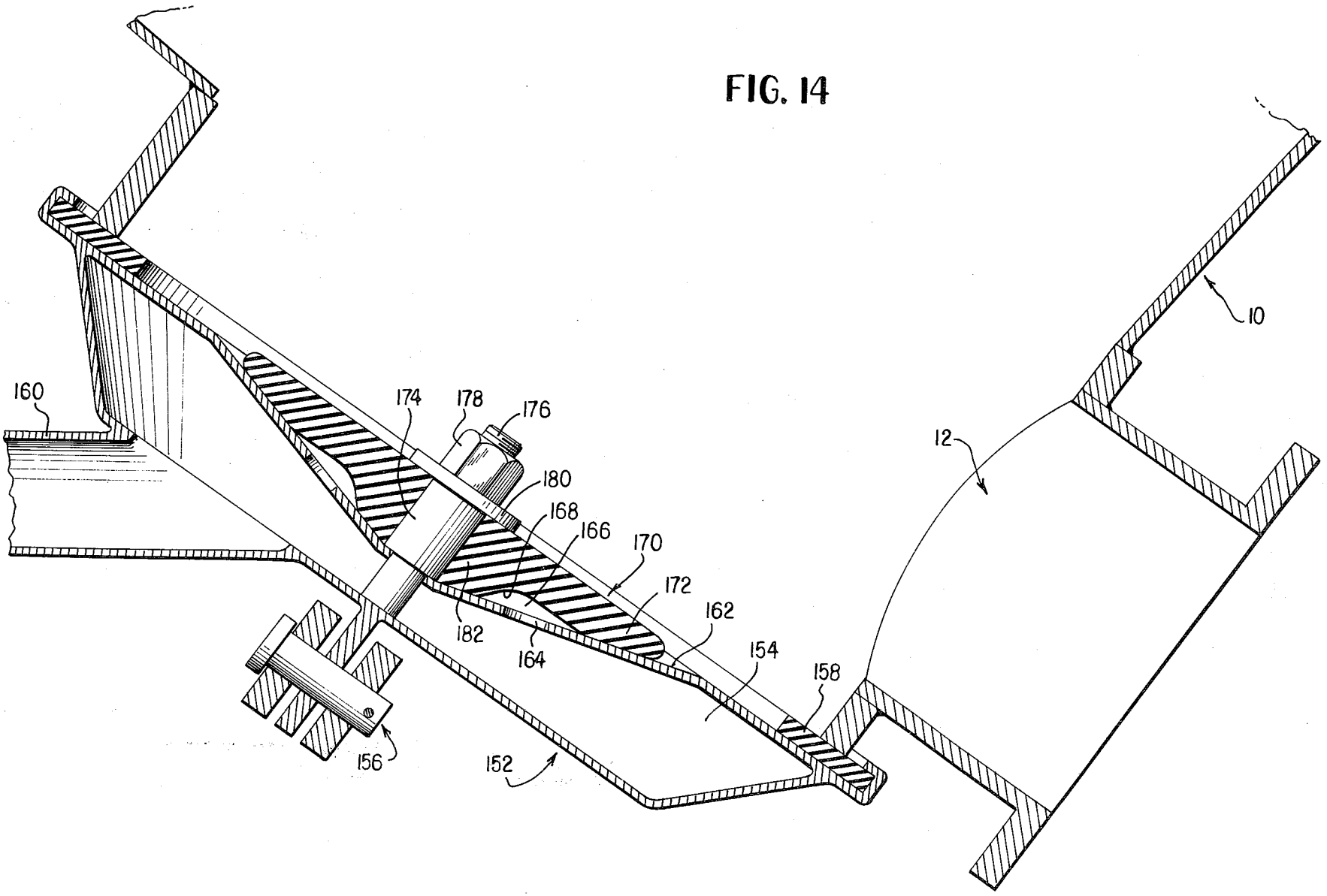
FIG. 14 is a view similar to FIG. 13 but showing a further modification of the invention.

FIG. 14 illustrates another embodiment of the invention wherein the agitating and aerating means in this case is mounted on the door assembly indicated generally by the reference character 152. The door construction is hollow as indicated to provide the interior manifold space 154 and is provided with a suitable releasable clamping means indicated generally by the reference character 156 by means of which the sealing gasket 158 carried by the door normally is sealingly engaged against the hopper structure as shown. The door is provided with an inlet pipe 160 by means of which the pressurized air is introduced into the manifold space 154 and the inner wall 162 of the door is provided with a series of openings 164 to direct air into the manifold space 166 provided by the undercut intermediate portion 168 of the flexible skirt 170. The wall 162 is dished as shown and the outer marginal edge 172 of the flexible skirt normally is maintained in face-to-face contact therewith as illustrated so that the jets of air which are randomly directed around the periphery of the flexible skirt inclined upwardly and outwardly. The door carries the stud 174 which is threaded at its outer end 176 to receive a nut 178 and washer 180 serving to anchor the intermediate portion 182 of the flexible device to the door.

Figure 15:
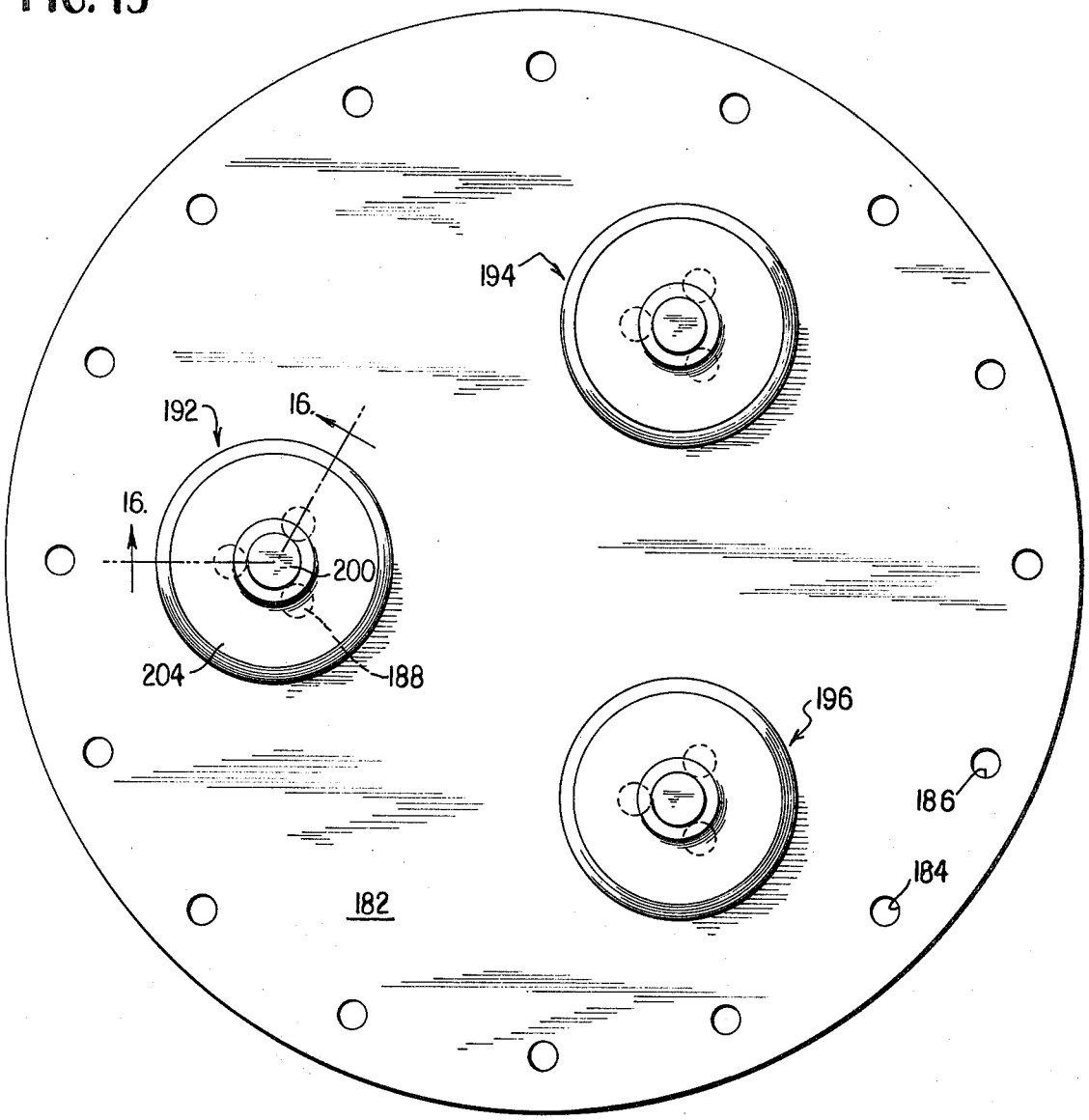
FIG. 15 is a plan view of a further modification of the invention.
Figure 16:
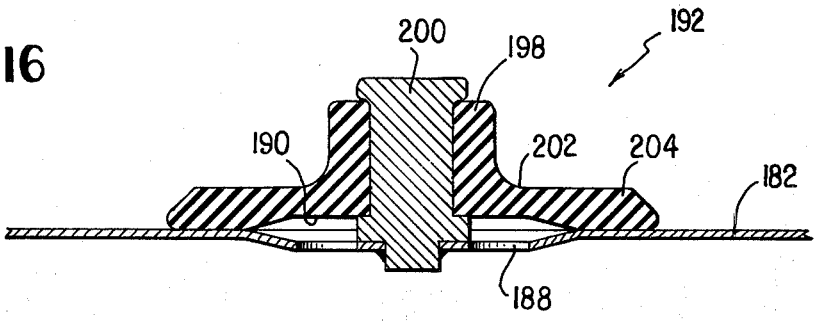
FIG. 16 is a section taken substantially along the plane of section line 16—16 in FIG. 15.

FIGS. 15 and 16 illustrate a particular form of the invention which is adapted to replace the circular porous pads which currently are employed for aeration purposes, as mentioned hereinbefore. To this end, a metal plate 182 is provided with a series of circumferentially spaced holes 184 so that this metal plate may be bolted to the interior of a hopper in the fashion that the currently employed porous pads are attached thereto. The conventional manifold structure or source of pressurized air is not shown in FIGS. 15 and 16 but it is to be understood that a closed chamber underlies the plate 182 in FIG. 16 to supply the pressurized air through the various openings 188 to the manifold spaces 190 of the three agitating and aerating means indicated by the reference characters 192, 194 and 196. As before, the central portions 198 of the resilient members are anchored on the stems 200 with the intermediate portions 202 thereof overlying the manifold space 190 and the outer marginal edge portions 204 thereof seated against the surfaces of the plate 182.

The disposition of the three assemblies 192, 194 and 196 on the plate 192 is such that they cumulatively achieve an aerating effect throughout the entire area of the plate 182. In this regard, it will be appreciated that the flow of air to a particular device 192, 194 or 196 as in all of the embodiments of the invention and the pressure of the air supplied to the interfaces thereof depends to some degree upon the size of the flexible skirt portions. Typical sizes of the skirt is from 3 to 8 inches in diameter for a circular configuration such as is shown for example in FIGS. 15 and 16 and typical flow rates per aerator will be from 10 to 400 standard cubic feet per minute with a typical pressure drop range when discharging into normal atmospheric pressure being 1 to 10 psig. In any event, the pressure of the air and the flow rate thereof are adjusted to cause the fluttering or vibrating effect in all instances whereby randomly directed and intermittent puffs or jets of air are expelled by reason of this fluttering or vibrating action.

What is claimed is:

1. A device for agitating and aerating pulverulent material, comprising in combination:

a base member defining a supporting surface and a flexible, resilient disc lying flatwise in face-to-face contact with said supporting surface, said supporting surface including a substantially flat annular portion and said disc including a substantially flat annular bottom surface portion in registry with said annular portion of the supporting surface;

said disc being of circular form having a central portion and an annular skirt projecting radially therefrom, said skirt defining an outer marginal edge portion presenting said annular bottom surface portion lying flatwise in face-to-face contact with said annular portion of said supporting surface and an intermediate portion joining said outer marginal edge portion to said central portion; and means securing said central portion of the disc to said base member for allowing said skirt to flex; and manifold means for subjecting substantially the entire circumferential extent of the bottom surface of said intermediate portion to the simultaneous application of air under pressure while said annular bottom surface portion of the outer marginal edge portion of the disc is in flatwise face-to-face contact with said annular portion of the supporting surface;

said skirt having a resiliency such that when subjected to an air flow of from 10–400 standard cubic feet per minute through said manifold means with a pressure drop in the range of 1 to 10 pounds per square inch when discharging into normal atmospheric pressure, said skirt is caused to flutter such randomly directed discrete puffs of air are expelled circumferentially of said skirt.

2. A device as defined in claim 1 wherein said base member is provided with an annular recess underlying said intermediate portion of the disc and defining therewith an annular chamber comprising said manifold means.

3. A device as defined in claim 2 wherein said bottom surface of said intermediate portion of the skirt is provided with an annular recess in substantial registry with said annular recess in the base member, the thickness of said intermediate portion due to such annular recess therein, being less than the thickness of said outer marginal edge portion of the skirt.

4. A device as defined in claim 2 wherein the outer margin of said annular recess is bevelled outwardly to form an obtuse angle with the interface between the bottom surface of said marginal edge portion of the skirt and said support surface.

5. A device as defined in claim 1 wherein the bottom of said intermediate portion of the skirt is provided with an annular recess overlying said base member and defining therewith an annular chamber comprising said manifold means.

6. A device as defined in claim 1 wherein said base member is provided with a series of closely spaced openings arranged in an annular path underlying said intermediate portion of the skirt and defining said manifold means therewith.

* * * * *